US009554954B2

(12) United States Patent
Hutchins et al.

(10) Patent No.: US 9,554,954 B2
(45) Date of Patent: Jan. 31, 2017

(54) CONVERTIBLE WHEELCHAIR

(71) Applicants: Theresa L. Hutchins, Durham, NC (US); Jeffrey L. Hutchins, Durham, NC (US); Donna M. Rich, Hillsborough, NC (US); Harvey Clyde Rich, Jr., Hillsborough, NC (US)

(72) Inventors: Theresa L. Hutchins, Durham, NC (US); Jeffrey L. Hutchins, Durham, NC (US); Donna M. Rich, Hillsborough, NC (US); Harvey Clyde Rich, Jr., Hillsborough, NC (US)

( * ) Notice: Subject to any disclaimer, the term of this patent is extended or adjusted under 35 U.S.C. 154(b) by 0 days.

(21) Appl. No.: 14/174,979

(22) Filed: Feb. 7, 2014

(65) Prior Publication Data

US 2015/0224002 A1 Aug. 13, 2015

(51) Int. Cl.

| | |
|---|---|
| ***A61G 5/10*** | (2006.01) |
| ***A61G 5/08*** | (2006.01) |
| ***A47C 13/00*** | (2006.01) |
| ***A47C 1/14*** | (2006.01) |

(52) U.S. Cl.

CPC . *A61G 5/08* (2013.01); *A47C 1/14* (2013.01); *A47C 13/00* (2013.01); *A61G 5/1067* (2013.01); *A61G 2005/0875* (2013.01); *A61G 2005/1054* (2013.01)

(58) Field of Classification Search

CPC ..... A61G 5/10; B62B 7/12; B60N 9/22
USPC ..... 280/630, 79.2, 657, 647, 648, 658; 297/DIG. 4

See application file for complete search history.

(56) References Cited

U.S. PATENT DOCUMENTS

| | | | | |
|---|---|---|---|---|
| 4,575,113 | A * | 3/1986 | Boudreau | 280/650 |
| 5,163,188 | A * | 11/1992 | Munroe | A61G 5/1002 297/DIG. 4 |
| 5,634,650 | A * | 6/1997 | Hensler et al. | 280/47.38 |
| 5,988,304 | A * | 11/1999 | Behrendts | 180/65.1 |
| 8,196,950 | B2 * | 6/2012 | Martin et al. | 280/648 |
| 2007/0241601 | A1 * | 10/2007 | Guerrini | 297/344.21 |
| 2010/0019472 | A1 * | 1/2010 | DiLorenzo, Sr. | 280/653 |

FOREIGN PATENT DOCUMENTS

| | | | |
|---|---|---|---|
| FR | 2604898 | A1 | 4/1988 |
| JP | 2007044461 | A | 2/2007 |

* cited by examiner

*Primary Examiner* — John Walters
*Assistant Examiner* — James Triggs
(74) *Attorney, Agent, or Firm* — James G. Passé; Passé Intellectual Property, LLC

(57) ABSTRACT

The present invention relates to a convertible wheelchair with a removable wheel assembly that can be replaced by a stationary stand for use at the beach and other loose gravel and sand locations.

7 Claims, 3 Drawing Sheets

CONVERTIBLE WHEELCHAIR

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to wheelchairs. In particular, it relates to a wheelchair that is convertible from a beach wheelchair to a beach lounge chair.

Description of Related Art

The use of a wheelchair allows those with disabilities to ambulate either by self propulsion, motor propulsion or by having someone push them. Currently the standard models of wheelchairs have relatively thin wheels of the type found on multispeed bicycles. While these types of wheels reduce rolling resistance on hard surfaces they are virtually useless on other types of surfaces such as sand, gravel and other loose material.

For use on the sand such as at the beach a different approach is utilized for wheelchairs. Very large surface wheels are utilized instead of the large diameter thin wheels. These wheels present a large surface on the sand and do not get stuck as easily in loose material. They are smaller in diameter and usually require someone to push the wheelchair. Typically as well they are made of materials that are not bothered by the water and sand, such as plastic, for both the frame and the seating material. Many varieties of plastic tubing combined with webbed seating are available.

However once the user is in place in the sand, the typical beach wheelchair has disadvantages. One issue is that the wheels and any push bar get in the way of the use as a beach chair especially if the seat is to be reclined. A second issue is that some people prefer to not be sitting in a wheelchair at the beach since it gives the appearance of going somewhere rather than relaxing. Currently, the only solution is to bring a second chair such as a beach lounge chair and transfer to the chair. This requires extra people or trips back to the car, though, to make possible.

BRIEF SUMMARY OF THE INVENTION

The present invention relates to the discovery that if the wheels on a beach wheelchair are on a frame that that can separate from the seating part of the beach wheelchair then the chair portion can be utilized as a beach chair by placing the separate part on the sand or placing it on a non-wheeled stand to place on the sand. Further, the wheelchair is water resistant.

Accordingly, in one embodiment there is a convertible wheelchair for use by an individual in sand comprising:

a) a lower portion wheel assembly frame comprising a plurality of wheels adapted for use in sand;

b) an upper portion chair frame separate from the lower portion of the frame comprising a seat for the individual wherein the upper portion releasably mounts on the lower portion wheel assembly frame; and c) a lower portion stand assembly which upper portion chair frame releasably mounts upon when not mounted on the wheel assembly;

DETAILED DESCRIPTION OF THE INVENTION

Figure 1:
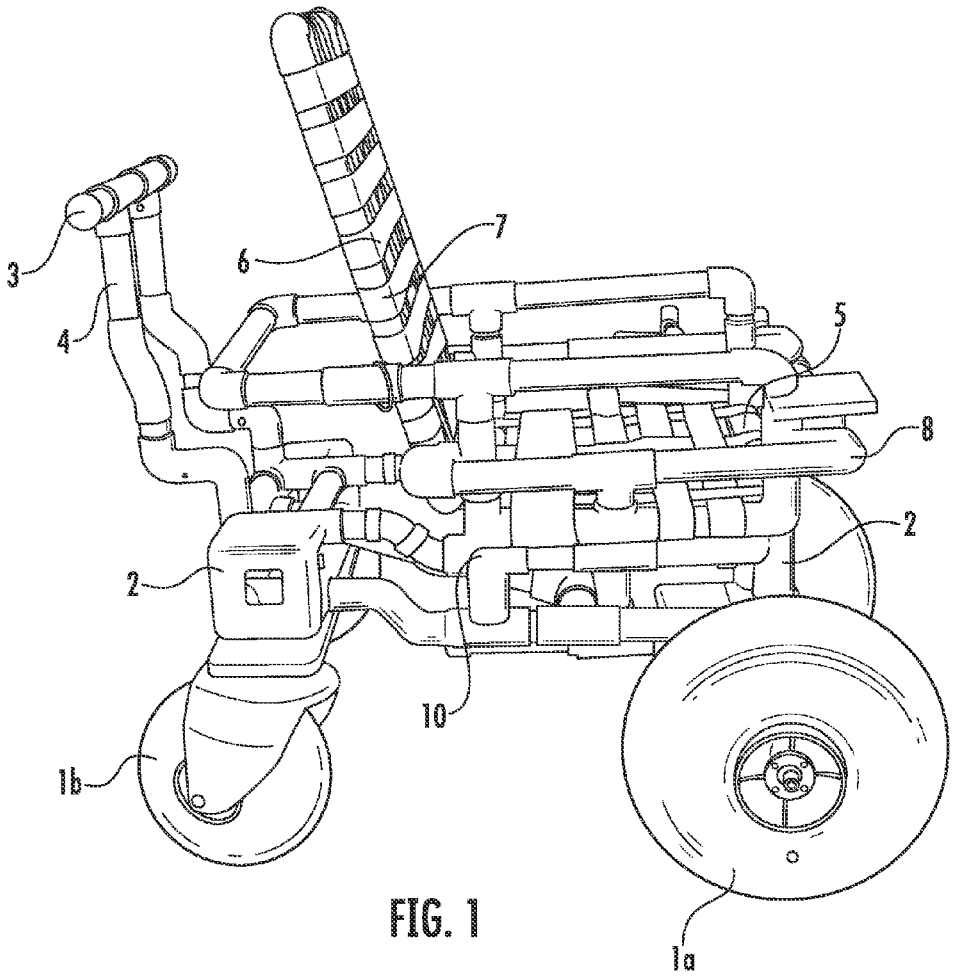
FIG. 1 is a side view of the wheelchair of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "convertible wheelchair" refers to a wheelchair which can convert from being a wheel device to a non-wheeled device. In general, it is designed for use at the beach where there is sand or other loose soil and use of the word sand includes all loose soil types wherein a specialized wheel assembly is necessary to traverse the soil.

As used herein an "individual is a person who would make use of a regular wheelchair in a situation of loose soil or sand of the type a regular thin wheel wheelchair would not traverse. Usually it is a patient with difficulty ambulating but of course can be anyone who cannot or does not want to walk.

As used herein a "lower portion wheel assembly frame" is an assembly comprising tubing or other structural members or timbers assembled in a fashion to hold a set of wheels for the wheelchair. In general, in one embodiment it is a rectangular structure with four wheels on it which are mounted inline or parallel or the like (facing the same direction) as in a regular wheelchair. The wheels are the standard wheels adapted to be used in sand or loose gravel or the like. In general, these are known as balloon tires and can be larger or smaller depending on the wheelchair size. One of skill in the art in view of this disclosure could choose wheels for the chair. The lower portion wheel assembly is its own separate piece which can attach to the upper portion chair frame. The frame that the wheels are mounted on can be plastic tubing as shown in the figures or any material that is suitable for the beach or sandy conditions and is relatively lightweight. In one embodiment, there is a push bar on the lower portion for pushing the individual when the wheelchair is assembled in its mobile configuration.

As used herein an "upper portion chair frame" is a frame assembly comprising a chair and a frame to support the chair. The frame is made of plastic or other lightweight water/sand resistant material with the chair being constructed as well of lightweight plastic or other waterproof materials. Unlike regular wheelchairs which can have cloth cushions or non-water resistant parts, the chair can be a beach lounge chair type material (plastic webbing as shown in the figures) or other suitable material. The chair itself can be rigid or can recline or otherwise be adjustable. The upper portion counts releasably on the lower wheel assembly to create a mobile configuration that is one that can be wheeled around as a whole piece. The releasable attachment can be by any means as long as it only takes a few seconds to mount or dismount, unlike bolts or welded wheelchair frame parts. In one embodiment the chair frame mounts on either of the lower portions by means of a series of larger diameter tubes fitting inside a larger diameter set of tubes as shown in the figures. As many mounting points would be used as desired to make the device stable but in general from about 3 to about 8 can be utilized and in one embodiment 4. The mobile configuration can be pushed by use of the push bar on the lower portion or a push bar on the upper portion.

As used herein the "lower portion stand assembly" refers to a second lower portion frame that the upper portion can releasably attach (in the same manner as the other lower assembly) to create a non-mobile or stationary configuration, i.e. one that does not roll around since it has no wheels. This converts the wheelchair into more of a beach lounge chair which does not have the general look and feel of a wheelchair but just a regular device for the beach. It can also be constructed of plastic tubing or other beach or water safe material. In general, as many water resistant parts as is possible would be utilized in one embodiment of the present invention.

In use, the upper chair frame is mounted on the wheel assembly frame and the individual sits in the seat. The wheelchair is wheeled to the sand on the beach and the chair portion lifted off the wheel assembly frame and places on the stand assembly for lounging on the beach.

Now referring to the drawings, FIG. 1 is a side view of the mobile configuration of the invention. Wheels adapted for sand, large 1*a* and small 1*b* are shown. In this view, these are balloon type tires. The wheels 1*a* and 1*b* (four in total) are mounted on lower portion wheel assembly frame 2. The frame 2 has push bar 3 mounted on push bar frame members 4. The seat 5 with reclining back 6 and webbing 7 is shown mounted in upper portion chair frame 8. It is noted that the frames of all the portions in the figures are plastic tubing made of schedule 40 PVC pipe. The upper portion is releasable from the wheeled frame 2 by releasable tube in tube releasable attachment 10 shown in finer detail in exploded FIG. 3.

Figure 2:
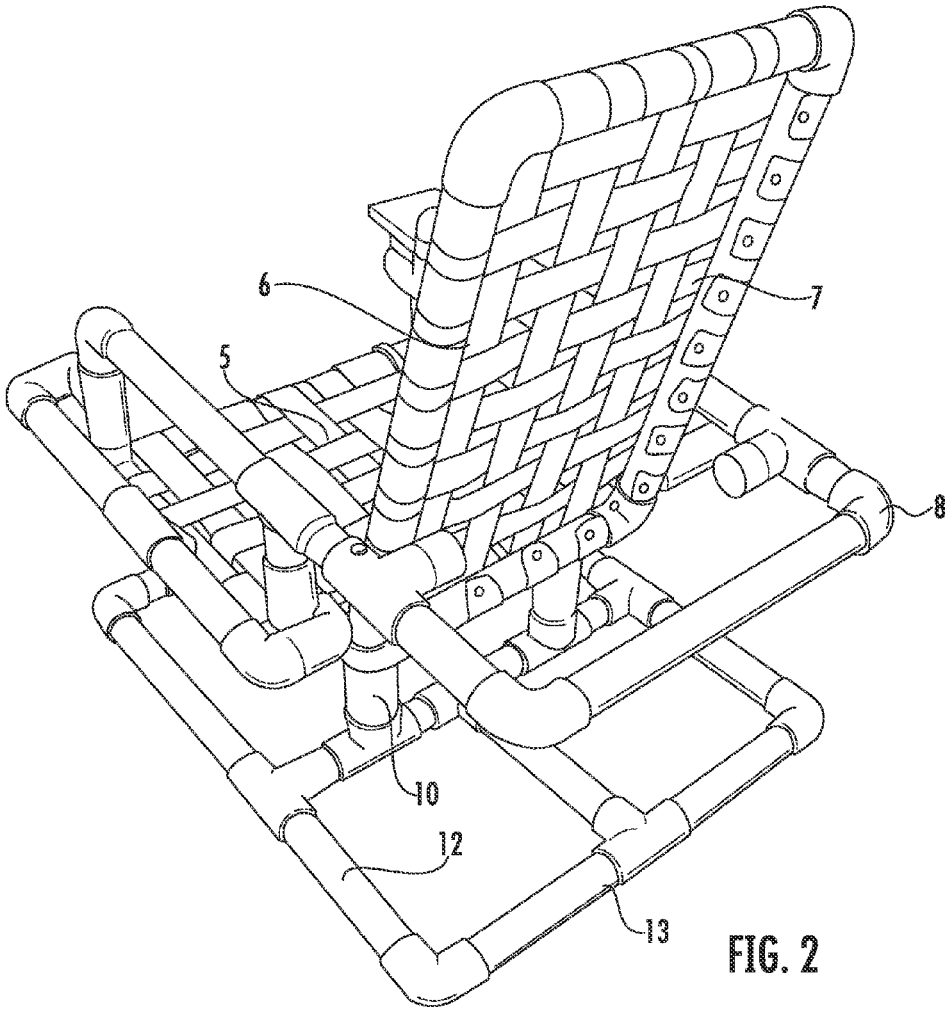
FIG. 2 is an angled view of the wheelchair on the stand with no wheels.

FIG. 2 is a perspective view of the stationary configuration consisting of the same upper portion as in FIG. 1. The upper portion, though, is mounted on lower stand assembly 12 which is a rectangular base 13 designed to support the upper portion when resting on the sand. One skilled in the art could make appropriate stands in view of the figures and descriptions herein.

Figure 3:
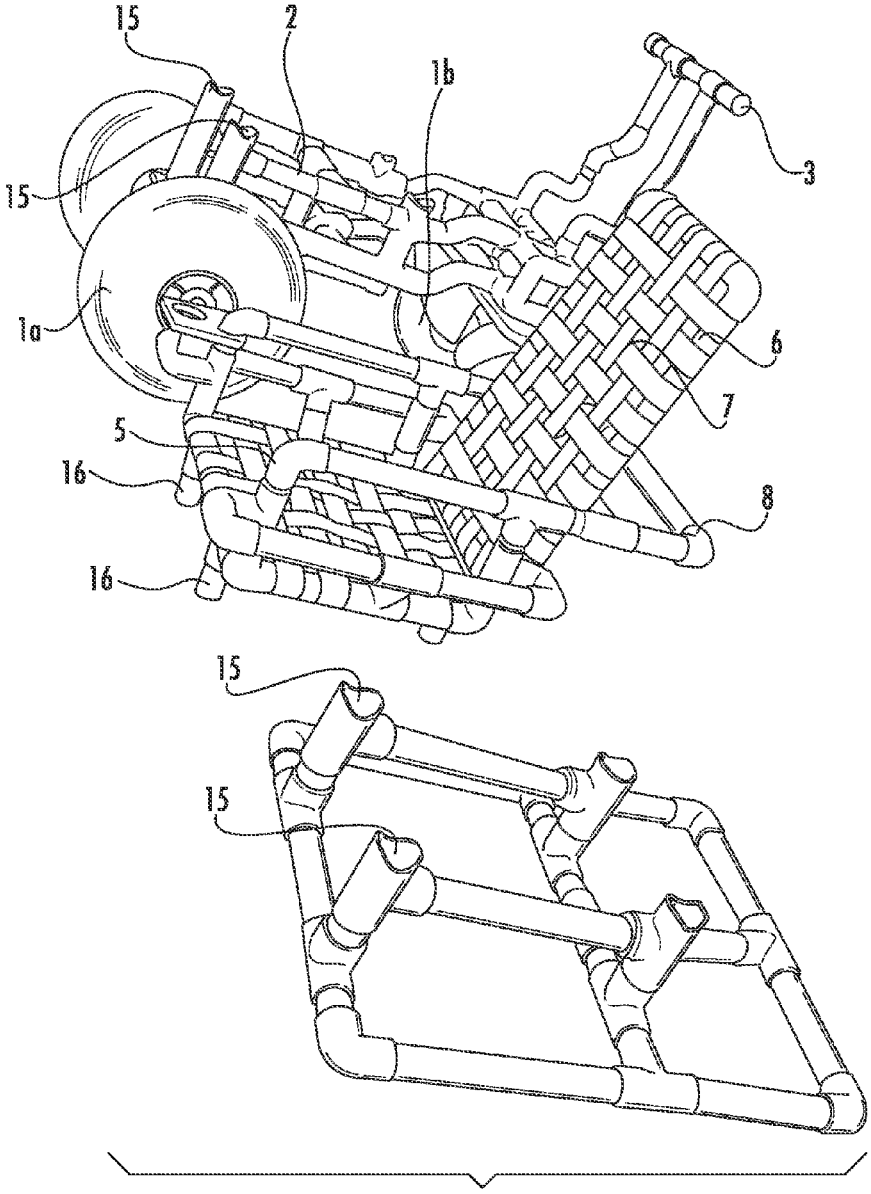
FIG. 3 is an exploded view of the 3 frame assemblies of the present invention.

FIG. 3 is a disassembled view of the three parts of the present invention: the two lower portions and the upper portion. While all the features are the same, one can clearly see the 5 larger diameter receiving tubes 15 in both lower portions and the smaller diameter inserting tubes 16 in the upper portion which allow the releasable mounting of an upper portion into one of the lower portions by gravity placement aligning the 4 tubes.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A convertible wheelchair for use by an individual outdoors, the wheelchair adapted for use outdoors in sand or loose gravel wherein a specialized wheel assembly is necessary, comprising:

a) a lower portion wheel assembly frame comprising a plurality of wheels adapted to be used outdoors in sand or loose gravel;

b) an upper portion seat frame separate from the lower portion wheel assembly frame consisting of a seat portion, the seat consisting of a chair for the individual, and a frame designed to hold the seat portion, wherein the upper portion releasably mounts on the lower portion wheel assembly frame and is adapted to be used outdoors;

c) a lower portion stationary stand assembly which upper portion frame releasably mounts upon when not mounted on the wheel assembly to provide a stationary seat portion consisting of a chair and is adapted to be used outdoors on sand or loose gravel in a seated configuration; and d) wherein the upper portion mounts on the wheel assembly frame to create a mobile configuration and alternately on the stand assembly to create a stationary seated configuration by means of a series of smaller diameter inserting tubes on the upper portion which fit releasably downward into a matching set of upward facing larger diameter receiving tubes individually in the lower portion wheel assembly and the lower portion stationary stand.

2. The wheelchair according to claim 1 wherein the back of the seat reclines.

3. The wheelchair according to claim 1 wherein a portion of the seat or back is covered with a polymer webbing material.

4. The wheelchair according to claim 1 wherein at least a portion of at least one of the lower wheel assembly frame, the upper chair frame and the lower stand assembly is constructed of polymeric tubing.

5. The wheelchair according to claim 1 wherein there is a push bar on the lower portion wheel assembly frame.

6. The wheelchair according to claim 1 wherein the wheelchair is assembled of water resistant parts.

7. A convertible wheelchair adapted for use by an individual outdoors in sand or loose gravel wherein a specialized wheel assembly is necessary comprising:

a) a lower portion wheel assembly frame comprising a plurality of wheels adapted to be used outdoors in sand or loose gravel;

b) an upper portion seat frame separate from the lower portion wheel assembly frame consisting of a seat portion, the seat consisting of a chair for the individual and a frame designed to hold the seat portion, wherein the upper portion releasably mounts on the lower portion wheel assembly frame and is adapted to be used outdoors;

c) a lower portion stationary stand assembly which upper portion frame releasably mounts upon when not mounted on the wheel assembly to provide a stationary seat portion consisting of a chair and is adapted to be used outdoors on sand or loose gravel in a seated configuration; and d) wherein the upper portion mounts on the wheel assembly frame to create a mobile configuration and alternately on the stand assembly to create a stationary seated configuration by means of a series of smaller diameter inserting tubes on the upper portion which fit releasably downward into a matching set of upward facing larger diameter receiving tubes individually in the lower portion wheel assembly and the lower portion stationary stand and wherein there is a push bar on the lower portion wheel assembly frame.

* * * * *